US009758267B2

(12) United States Patent
Mueller

(10) Patent No.: US 9,758,267 B2
(45) Date of Patent: Sep. 12, 2017

(54) APPARATUS AND METHOD FOR FILLING CONTAINERS

(71) Applicant: Robert Bosch GmbH, Stuttgart (DE)

(72) Inventor: Martin J. Mueller, Oldsmar, FL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/164,355

(22) Filed: May 25, 2016

(65) Prior Publication Data

US 2016/0347490 A1 Dec. 1, 2016

Related U.S. Application Data

(60) Provisional application No. 62/166,775, filed on May 27, 2015.

(51) Int. Cl.

| | |
|---|---|
| ***B65G 35/06*** | (2006.01) |
| ***B65G 37/00*** | (2006.01) |
| ***B65B 43/50*** | (2006.01) |
| ***B65B 43/52*** | (2006.01) |
| ***B65B 43/42*** | (2006.01) |
| *B65B 3/00* | (2006.01) |

(52) U.S. Cl.

CPC ..... *B65B 43/50* (2013.01); *B65B 43/42* (2013.01); *B65B 43/52* (2013.01); *B65B 3/00* (2013.01)

(58) Field of Classification Search

CPC ..... B65G 35/06; B65G 37/00; B65G 17/002
USPC .... 198/795, 465.1, 803.2, 793, 463.3, 468.7
See application file for complete search history.

(56) References Cited

U.S. PATENT DOCUMENTS

| | | | | |
|---|---|---|---|---|
| 3,564,812 A | | 2/1971 | Mueller et al. | |
| 4,324,326 A | * | 4/1982 | Khoylian | B65G 17/002 198/465.3 |
| 4,473,098 A | | 9/1984 | Sawvel | |
| 6,398,538 B1 | | 6/2002 | Padovani | |
| 8,813,940 B2 | | 8/2014 | Junk | |

(Continued)

FOREIGN PATENT DOCUMENTS

| | | |
|---|---|---|
| DE | 29 13 026 A1 | 10/1980 |
| GB | 1 460 897 A | 1/1977 |
| JP | 2001-158533 A1 | 6/2001 |

OTHER PUBLICATIONS

International Search Report and Written Opinion for PCT/US16/34025 mailed Sep. 7, 2016.

*Primary Examiner* — Gene Crawford
*Assistant Examiner* — Lester Rushin
(74) *Attorney, Agent, or Firm* — Wood, Phillips, Katz, Clark & Mortimer

(57) ABSTRACT

A filling apparatus for filling containers, and a method of operation, are disclosed, whereby a plurality of container carriers are movable along an upper container guideway of the apparatus. Notably, a pair of servo drives in the form of linear actuators act generally in opposition to each other, at opposites ends to the container carriers movable along the container guideway, to accurately index and position the container carriers with respect to associated filling equipment. Servo-driven transfer wheels, positioned at respective opposite ends of the upper container guideway, effect movement of the containers to and from a return conveyor positioned beneath the upper container guideway, whereby the container carriers are moved from the downstream end of the filling region back to the upstream end thereof.

5 Claims, 1 Drawing Sheet

(56) References Cited

U.S. PATENT DOCUMENTS

| | | | | |
|---|---|---|---|---|
| 2007/0170045 | A1* | 7/2007 | Rovers | B65G 17/002 198/867.11 |
| 2010/0326794 | A1* | 12/2010 | Manzon | B65G 47/53 198/463.3 |
| 2014/0174893 | A1 | 6/2014 | Junk | |

* cited by examiner

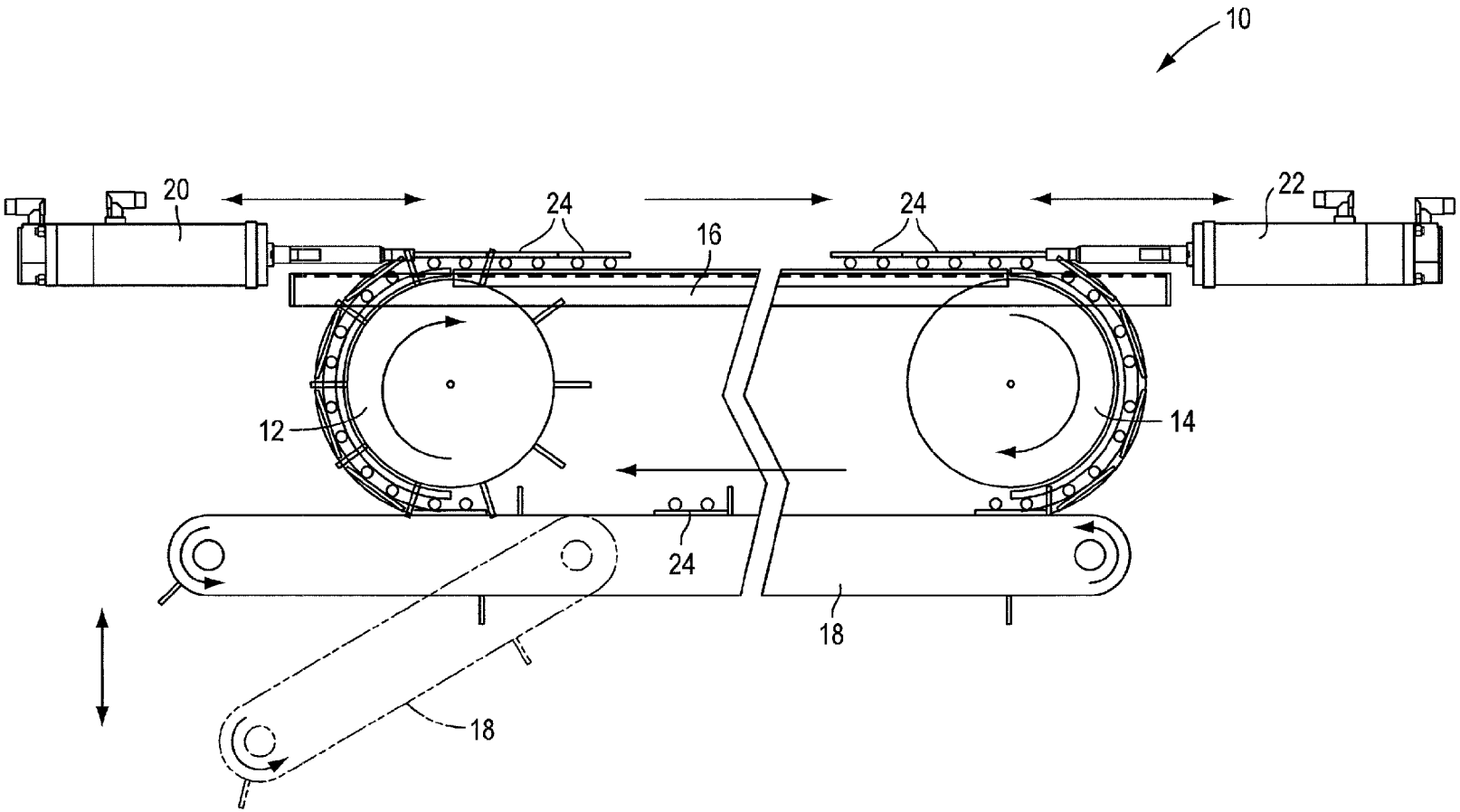
10
22
14
24
16
24
18
24
18
12
20

APPARATUS AND METHOD FOR FILLING CONTAINERS

TECHNICAL FIELD

The present invention relates to an apparatus for filling containers, and more particularly to a container-filling apparatus that includes a plurality of servo-driven components, including a pair of servo-driven transfer wheels, and a pair of linear actuators, for selectively and intermittently moving a plurality of container carriers, without associated chain conveyor drives or the like. A method of filling containers is also disclosed.

BACKGROUND OF THE INVENTION

Automated equipment for effecting filling of containers with flowable food products, such as yogurt, ice cream, and the like typically include chain-driven conveyor arrangements, whereby groups of containers are presented to associated filling equipment for filling and subsequent packaging. Container filling is typically effected along an upper run of the conveyor, with a lower run of the conveyor returning the container carrier elements back to the upstream region of the filling area.

U.S. Pat. No. 8,813,940 B2, U.S. Patent Publication No. 2014/0174893 A1, and U.S. Pat. No. 6,398,538, all of which are hereby incorporated by reference, show various container filling arrangements.

The present invention improves upon previous filling arrangements by providing precise control of container carriers during product filling, and efficient return of the carriers to an upstream portion of the filling area after removal of the filled containers.

SUMMARY OF THE INVENTION

In accordance with the present invention, a container filling apparatus, and a method of filling containers, are disclosed which effect precise and efficient positioning of containers for filling by associated equipment. In distinction from previous arrangements, the present invention includes an arrangement of servo-driven components which are operable together to precisely position and index carriers for the containers during filling, and which permit the carriers to be efficiently returned to the filling area after removal of the filled containers.

In accordance with the illustrated embodiment, the present container-filling apparatus includes a first transfer wheel, and a second transfer wheel arranged in spaced apart relationship, and an upper container guideway extending between the first and second transfer wheels.

The apparatus further includes a lower container conveyor extending between the first and second transfer wheels beneath the upper container guideway, and a plurality of container carriers which are individually movable along the upper container guideway, and which are individually moveable by the first and second transfer wheels and the lower container conveyor.

First and second linear actuators are provided positioned at respective opposite ends of the upper container guideway for controlling movement of the container carriers along the upper container guideway. By this arrangement, each of the container carriers is: (a) movable from the lower container conveyor upwardly to the upper container guideway by the first transfer wheel; (b) movable by the first and second linear actuators along the upper container guideway to present one or more containers carried by the container carrier for filling; (c) movable downwardly from the upper container guideway to the lower container conveyor (18) by the second transfer wheel; and (d) movable from the second transfer wheel to the first transfer wheel by the lower container conveyor.

Each of the first and second transfer wheels, and the lower container conveyor, are servo-driven for precise and efficient control. Additionally, the first and second linear actuators act in concert with each other to control the positioning of each of the container carriers as said carriers are moved along said upper container guideway.

In accordance with the present invention, a method of filling containers comprises the steps of providing a first transfer wheel and a second transfer wheel arranged in spaced apart relationship, and an upper container guideway extending between the first and second transfer wheels. The present method further comprises providing a lower container conveyor extending between the first and second transfer wheels beneath the upper container guideway.

The present method further includes providing a plurality of container carriers (24) which are individually movable along the upper container guideway, and which are individually moveable by the first and second transfer wheels and the lower container conveyor (18).

Filling of the containers is effected by: (a) moving each of said container carriers from the lower container conveyor upwardly to the upper container guideway by the first transfer wheel; (b) thereafter controlling movement of the container carrier along the upper container guideway with first and second linear actuators, to thereby present one or more containers carried by the container carrier for filling; (c) thereafter moving the container carrier downwardly from the upper container guideway to the lower container conveyor by the second transfer wheel; and (d) thereafter moving the container carrier from the second transfer wheel to the first transfer wheel by the lower container conveyor.

In accordance with the invention, it is contemplated that five (5) servo-drives are employed, two for the first and second transfer wheels, which may comprise typical rotary servo-drives, and two linear actuators, i.e. servos. An additional servo-drive is employed for the lower conveyor, which functions as a return belt for the container carriers.

The container carriers, which are typically plate-like, are picked up from the lower conveyor, and brought around by the first transfer wheel, shown at the left in the appended drawing. This is effected in a "free-wheeling" manner, such as on a discharge unit on a standard container-filling machine. Precise positioning or accuracy is not required for this movement of the container carrier. This arrangement obviates the need for elevators and like mechanisms which require accurate position and precise operation, and thus will provide much faster to transport of the carriers to the upstream end of the filling region, and will facilitate convenient and efficient set-up of the apparatus.

Once the plate-like container carrier is brought to the top, the transfer wheel stops and the linear motion actuator takes over and pushes the carrier plate forward the required indexing distance, whatever the carrier plate size requires to move forward. Notably, the second linear actuator at the downstream end of the filling region puts resistance to the last plate. It is contemplated that such resistance is not necessarily to slow the speed of the carrier plate, but rather to provide precise positioning and control of the carrier as it is advanced through the filling region, particularly as operational speeds are increased. This resistance provides by the second linear actuator will act to contain and control the "train" or series of carrier plates so they do not "free-wheel", and can moved at a desired rate of speed to the correct position. Shock and impact between the container carriers can be absorbed and controlled by the linear actuators.

Once the group of carrier plates has indexed forward, the second linear actuator releases, and the carrier plate goes around the second transfer wheel to the bottom of the arrangement, where it is picked up by the freewheeling belt of the lower container conveyor and transported once again toward the first transfer wheel at front of the apparatus.

It is presently contemplated that either a portion, or the entire length, of the lower container conveyor be mounted for vertical pivotal movement to thereby facilitate movement of the container carriers onto and off of one end of the lower conveyor in a lowered position thereof. This facilitates changing the apparatus, such as for handling differently sized containers, by replacing one set of the container carriers with a different set of the carriers, or otherwise adding, removing, and/or replacing container carriers as may be desired. A suitable pocket elevator or the like can be provided in operative association with the lower conveyor in its lowered position to facilitate loading, unloading, and storage of the container carriers.

Desirably, no elevator arrangements or the like are required, nor does the arrangement require the accuracy typically requiring the use of gear drives, worm drives or any like drives typically found in previous devices. Problems associated with the typical stretching and elongation of drive chains are desirably avoided. The container carrier plates are driven on wheels, with roughly half as many such carriers required as on a standard machine, because there will only be the minimum number of container carriers necessary on the bottom return leg. Since the carrier plates are not fastened to a conveyor chain, it is very easy to automate removal of the carrier plates to accommodate another size of container carrier plate. Since machining of the carrier plates needs to be accurate, it is contemplated that the carrier plates be provided with small push pads, set into the plates, to push one another alone. These can be easily machined to the correct size, and can be changed if damaged or worn, although this may not be required for machines operating at slower speeds. In accordance with the illustrated embodiment, the present container-filling apparatus includes a first transfer wheel, and a second transfer wheel arranged in spaced apart relationship, and an upper container guideway extending between the first and second transfer wheels.

BRIEF DESCRIPTION OF THE DRAWING

FIG. 1 is a side elevational, diagrammatic view showing the filling apparatus fo the present invention.

DETAILED DESCRIPTION OF THE INVENTION

While the present invention is susceptible of embodiment in various forms, there is shown in the drawing and will hereinafter be described a presently preferred embodiment of the invention, with the understanding that the present disclosure is not intended and should not be inferred to limit the invention other specific embodiment which is illustrated In accordance with the present invention, a container filling apparatus, and a method of filling containers, are disclosed which effect precise and efficient positioning of containers for filling by associated equipment. In distinction from previous arrangements, the present invention includes an arrangement of servo-driven components which are operable together to precisely position and index carriers for the containers during filling, and which permit the carriers to be efficiently returned to the filling area after removal of the filled containers.

In accordance with the illustrated embodiment, the present container-filling apparatus 10 includes a first transfer wheel 12, and a second transfer wheel 14 arranged in spaced apart relationship, and an upper container guideway 16 extending between the first and second transfer wheels 12, 14.

The apparatus 10 further includes a lower container conveyor 18 extending between the first and second transfer wheels 12,14 beneath the upper container guideway 16, and a plurality of container carriers which are individually movable along the upper container guideway, and which are individually moveable by the first and second transfer wheels and the lower container conveyor 18.

First and second linear actuators 20, 22 are provided positioned at respective opposite ends of the upper container guideway 16 for controlling movement of the container carriers 24 along the upper container guideway. By this arrangement, each of the container carriers is: (a) movable from the lower container 18 conveyor upwardly to the upper container guideway 16 by the first transfer wheel 12; (b) movable by the first and second linear actuators 20, 22 along the upper container guideway to present one or more containers carried by the container carrier 24 for filling; (c) movable downwardly from the upper container guideway 16 to the lower container conveyor 18 by the second transfer wheel 14; and (d) movable from the second transfer wheel 14 to the first transfer wheel 12 by the lower container conveyor 18.

Each of the first and second transfer wheels 12, 14, and the lower container conveyor 18, are servo-driven for precise and efficient control. Additionally, the first and second linear actuators 20, 22 act in concert with each other to control the positioning of each of the container carriers 24 as the carriers are moved along the upper container guideway 16.

In accordance with the present invention, a method of filling containers comprises the steps of providing a first transfer wheel 12 and a second transfer wheel 14 arranged in spaced apart relationship, and an upper container guideway 16 extending between the first and second transfer wheels. The present method further comprises providing a lower container conveyor 18 extending between the first and second transfer wheels 12, 14 beneath the upper container guideway 16.

The present method further includes providing a plurality of container carriers 24 which are individually movable along the upper container guideway 16, and which are individually moveable by the first and second transfer wheels 12, 14 and the lower container conveyor 18.

Filling of the containers is effected by: (a) moving each of said container carriers 24 from the lower container conveyor 18 upwardly to the upper container guideway 16 by the first transfer wheel 12; (b) thereafter controlling movement of the container carrier 24 along the upper container guideway 16 with first and second linear actuators 20, 22, to thereby present one or more containers carried by the container carrier 24 for filling; (c) thereafter moving the container carrier 24 downwardly from the upper container guideway 16 to the lower container conveyor 18 by the second transfer wheel 14; and (d) thereafter moving the container carrier 24 from the second transfer wheel 14 to the first transfer wheel 12 by the lower container conveyor 18)

In accordance with the invention, it is contemplated that five (5) servo-drives are employed, two for the first and second transfer wheels 12, 14, which may comprise typical rotary servo-drives, and two linear actuators 20, 22, i.e. linear servos. An additional servo-drive is employed for the lower conveyor 18, which functions as a return belt for the container carriers 24.

The container carriers 24, which are typically plate-like, are picked up from the lower conveyor 18, and brought upwardly and around by the first transfer wheel 12, shown at the left in the appended drawing. This is effected in a "free-wheeling" manner, such as on a discharge unit on a standard container-filling machine. Precise positioning or accuracy is not required for this movement of the container carrier. This arrangement obviates the need for elevators and like mechanisms which require accurate positioning and precise operation, and thus are much faster to transport of the carriers 24 to the upstream end of the filling region, and will facilitate convenient and efficient set-up of the filling apparatus 10.

Once the plate-like container carrier 24 is brought to the top, the transfer wheel 12 stops and the linear motion actuator 20 takes over and pushes the carrier plate 24 forward the required indexing distance, whatever the carrier plate size requires to move forward. Notably, the second linear actuator 22 at the downstream end of the filling region puts resistance on the last plate-like container carrier 24 positioned along the upper container guideway 16. It is contemplated that such resistance is not necessarily to slow the speed of the carrier plate, but rather to provide precise positioning and control of the carrier as it is advanced through the filling region, particularly as operational speeds are increased. This resistance provided by the second linear actuator will act to contain and control the "train" or series of container carrier plates so they do not "free-wheel", and can moved at a desired rate of speed to the correct position. Shock and impact between the container carriers can be absorbed and controlled by the linear actuators 20, 22.

Once the group of container carriers 24 has indexed forward, the second linear actuator 22 releases, and the carrier plate 24 at the downstream end of the filling region goes around the second transfer wheel 14 to the bottom of the arrangement, where it is picked up by the freewheeling belt of the lower container conveyor 18 and transported once again toward the first transfer wheel 12 at front of the apparatus.

As illustrated, it is presently contemplated that either a portion, or the entire length, of the lower container conveyor 18 be mounted for vertical pivotal movement to thereby facilitate movement of the container carriers 24 onto and off of one end of the lower conveyor 18 in a lowered position thereof. This facilitates changing the apparatus, such as for handling differently sized containers, by replacing one set of the container carriers 24 with a different set of the carriers, or otherwise adding, removing, and/or replacing container carriers as may be desired. A suitable pocket elevator or the like (not shown) can be provided in operative association with the lower conveyor 18 in its lowered position to facilitate loading, unloading, and storage of the container carriers.

Desirably, no elevator arrangements or the like are required, nor does the present filling arrangement require the accuracy typically requiring the use of gear drives, worm drives or any like drives typically found in previous devices. Problems associated with the typical stretching and elongation of drive chains are desirably avoided. The container carrier plates 24 are driven on wheels, with roughly half as many such carriers required as on a standard machine, because there will only be the minimum number of container carriers necessary on the bottom return leg. Since the carrier plates 24 are not fastened to a conveyor chain, it is very easy to automate removal of the carrier plates to accommodate another size of container carrier plate. Since machining of the carrier plates needs to be accurate, it is contemplated that the container carrier plates be provided with small push pads, set into the plates, to push one another alone. These can be easily machined to the correct size, and can be changed if damaged or worn, although this may not be required for machines operating at slower speeds.

From the forgoing, it will be observed that numerous modifications and variations can be effected without departing from the true spirit and scope of the present invention. It is to be understood that no limitation with respect to the specific embodiment illustrated herein is intended or should be inferred. The disclosure is intended to cover by the appended claims all such modifications as fall within the scope of the claims.

What is claimed is:

1. An apparatus (10) for filling containers, comprising:

a first transfer wheel (12), and a second transfer wheel (14) arranged in spaced apart relationship;

an upper container guideway (16) having a length extending between said first and second transfer wheels (12,14), a lower container conveyor (18) extending between said first and second transfer wheels (12,14) beneath said upper container guideway (16);

a plurality of container carriers (24) individually movable along said upper container guideway (16), and individually moveable by said first and second transfer wheels (12,14) and said lower container conveyor (18); and first and second linear actuators (20,22) positioned at respective opposite lengthwise ends of said upper container guideway (16) for controlling movement of said container carriers (24) along the length of said upper container guideway, the apparatus configured so that each of said container carriers (24) is: (a) movable from said lower container conveyor (18) upwardly to said upper container guideway (16) by said first transfer wheel (12); (b) movable by said first and second linear actuators (20,22) along the length of said upper container guideway (16) to i) present one or more containers carried by the container carrier (24) controllably along the length of the guideway for filling and ii) advance the container carrier (24)to the second transfer wheel (14); (c) movable downwardly from said upper container guideway (16) to said lower container conveyor (16) by said second transfer wheel (14); and (d) movable from said second transfer wheel (14) to said first transfer wheel (12) by said lower container conveyor (18).

2. An apparatus (10) for filling containers in accordance with claim 1, wherein each of said first and second transfer wheels (12,14), said lower container conveyor (16), are servo-driven.

3. An apparatus (10) for filling containers in accordance with claim 1, wherein said first and second linear actuators (20,22) act in concert with each other to control the positioning of each of said container carriers (24) as said carriers are moved along said upper container guideway (16).

4. An apparatus for filling containers in accordance with claim 1, wherein said lower container conveyor is mounted for vertical pivotal movement to facilitate movement of said container carriers onto and off of one end of said lower conveyor in a lowered position thereof.

5. A method filling a plurality of containers, comprising the steps of:

providing a first transfer wheel (12), and a second transfer wheel (14) arranged in spaced apart relationship, and an upper container guideway (16) having a length extending between said first and second transfer wheels (12,14), providing a lower container conveyor (16) extending between said first and second transfer wheels (12,14) beneath said upper container guideway (16);

providing a plurality of container carriers (24) individually movable along said upper container guideway (16), and individually moveable by said first and second transfer wheels (12,14) and said lower container conveyor (18); and (a) moving each of said container carriers (24) from said lower container conveyor (18) upwardly to said upper container guideway (16) by said first transfer wheel (12); (b) thereafter controlling movement of the container carrier (24) along the length of said upper container guideway (16) with first and second linear actuators (20,22), to thereby i) present one or more containers carried by the container carrier (24) controllably along the length of the guideway for filling and ii) advance the container carrier (24) to the second transfer wheel (14); (c) thereafter moving the container carrier (24) downwardly from said upper container guideway (16) to said lower container conveyor (18) by said second transfer wheel (14); and (d) thereafter moving the container carrier (24) from said second transfer wheel (14) to said first transfer wheel (12) by said lower container conveyor (18).

* * * * *